United States Patent [19]

Dunn

[11] Patent Number: 4,620,722

[45] Date of Patent: Nov. 4, 1986

[54] SKI AND POLE HOLDER

[76] Inventor: Stephen H. Dunn, R.M.B. 85 Windsor Rd., Baulkham Hills 2153, Australia

[21] Appl. No.: 747,307

[22] Filed: Jun. 21, 1985

[30] Foreign Application Priority Data

Jun. 22, 1984 [AU] Australia ..... PG5632

[51] Int. Cl.[4] ..... A63C 11/02

[52] U.S. Cl. ..... 280/814; 224/917; 294/147

[58] Field of Search ..... 280/814, 809; 224/917; 16/227, 232, 344; 294/147

[56] References Cited

U.S. PATENT DOCUMENTS

| | | | |
|---|---|---|---|
| 874,746 | 12/1907 | Dennis | 16/344 |
| 3,260,430 | 7/1966 | Sandenburgh | 280/814 |
| 3,343,206 | 9/1967 | Mennerheimo | 16/344 |
| 3,976,234 | 8/1976 | Moudry et al. | 280/814 |
| 4,144,728 | 3/1979 | Boynton et al. | 280/814 X |
| 4,165,027 | 8/1979 | Briggs | 280/814 X |
| 4,269,435 | 5/1981 | Jarvenkyla et al. | 280/814 |
| 4,494,787 | 1/1985 | Gainey | 280/814 X |

*Primary Examiner*—John J. Love
*Assistant Examiner*—Michael Mar
*Attorney, Agent, or Firm*—Oblon, Fisher, Spivak, McClelland & Maier

[57] ABSTRACT

A ski and pole carrier consists of a substantially rigid base member having an outwardly projecting lug against which the edge of at least one of the skis may bear. A flexible strap is slideably engaged on the base member and is secured by its other end to the base member so as to strap the skis to the base member. The pole holder is pivotably connected to the base member and has resilient clips for retaining the poles. When not in use, the pole support member may be folded down against the ski support member.

3 Claims, 3 Drawing Figures

SKI AND POLE HOLDER

FIELD OF INVENTION

This invention relates to a holder for carrying a pair of skis and poles together as a single unit.

Skis and poles are rather awkward and cumbersome to carry and a measure of inconvenience occurs because of the incompatible design of the skis and poles.

BACKGROUND ART

A ski and stock carrier is disclosed in U.S. Pat. No. 4,165,027 which includes a flexible strap that is wrapped around a pair of skis. Attached to the strap is a clamp block having an elongated aperture into which the poles are forced. The poles are held in position by a further flexible strap that is secured over the opening to the clamp block. One disadvantage of that ski and stock carrier is that there is no rigid base against which the skis can be positioned whilst the strap is being secured.

DISCLOSURE OF INVENTION

It is an object of this invention to provide an improved ski and stock carrier which is in the form of a single unit. It is a further object of the invention to provide a ski and stock carrier that can be folded into a compact unit when not in use.

According to the invention there is provided a ski and pole holder comprising a substantially rigid base member adapted to support a pair of skis, a flexible strap secured by one end to the base member and having means at its other end to engage the base member so as to strap skis to the base member.

BRIEF DESCRIPTION OF DRAWINGS

In order that the invention may be more readily understood and put into practical effect, reference will now be made to the accompanying drawings in which.

DESCRIPTION OF PREFERRED EMBODIMENT

Figure 1:
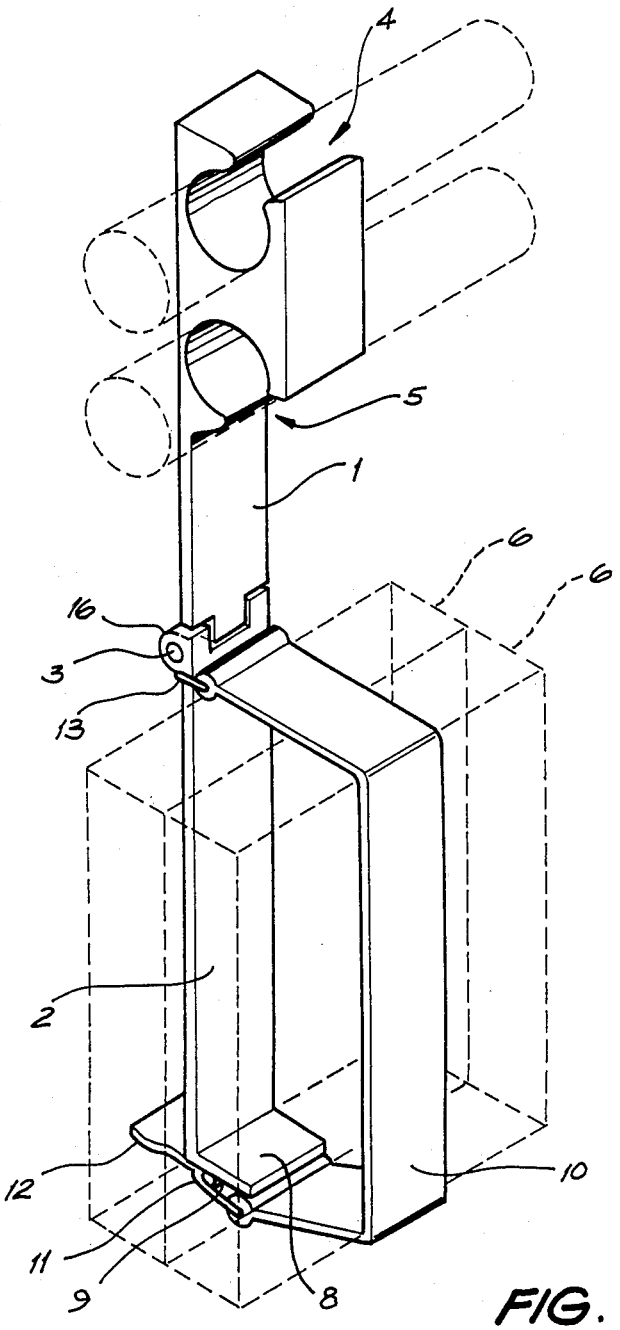
FIG. 1 is a perspective view of a ski and pole holder according to one embodiment of the invention.

The ski and pole holder shown in the drawings includes a substantially rigid pole support member 1 having two partially opened, resilient, circular clips 4 and 5 at its upper end for receiving poles in a horizontal position. The poles are forced into the clips 4 and 5 which, when the poles are in position, return to their original position to lock the poles therein.

The ski and pole holder also includes a substantially rigid ski support member or base member 2 having an outwardly projecting lug 8 against which the edge of at least one of the skis may bear. The lower extremity of the base support member 2 has a lug 9 which defines recesses 14 and 15 on either side of and beneath the base support member 2. A substantially elastic strap 10 is secured to the base member 2 by means of a wire band 13 that is free to slide along the upper end of the base member 2 so as to permit adjustment of the strap when binding the skis to the base member 2.

At the lower end of the strap 10 there is a wire loop 11 having a tag 12 by means of which the band 11 may be moved into and out of engagement with the recesses

14 or 15. The pole support member 1 is hinged to the base member 2 by hinge means 3 which is located within an enlarged portion 16 at the top of the base member 2.

In order to strap the skis to the holder, the skis are placed with their flat faces together and one holder according to the invention is positioned in front of the ski bindings and another holder behind the bindings. The skis 6 are then held firmly against the base member 2 and the horizontal lug 8 by means of the elastic strap 10 which is secured to the recess 14 formed by the lug 8. The poles are then inserted into the resilient clips 4 and 5 and the skis and poles so coupled together can be carried as a single unit by holding the poles between each holder.

Figure 2:
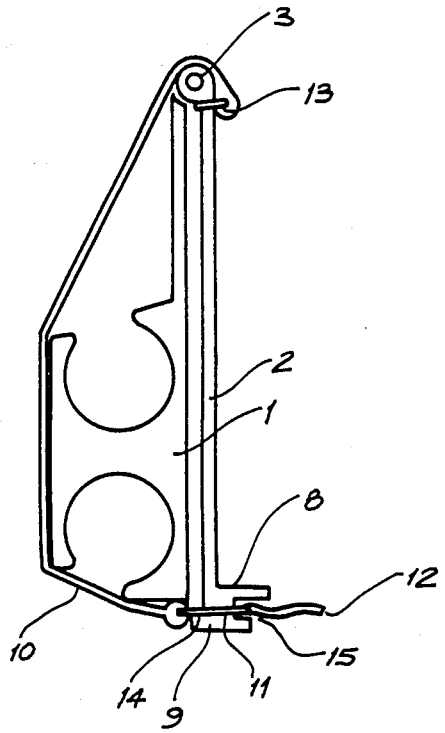
FIG. 2 is a side elevation view of the ski and pole holder shown in FIG. 1 folded into its storage position, and, FIG. 3 is a partly broken away side elevation view of a modification of the invention.

When the holder is not in use, the pole support member 1 can be swung down into a folded position as shown in FIG. 2 with substantially flat surfaces of pole support member 1 and base member 2 adjacent one another, and locked in position by the flexible strap 10 which passes over the top of base member 2 so that the wire loop 11 can engage into the recess 15.

Figure 3:
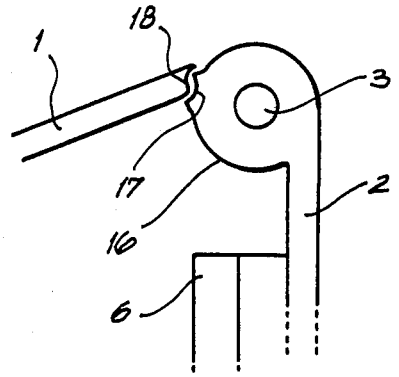

In the modification of the invention shown in FIG. 3, the outer periphery of the enlarged portion 16 is notched at 17 to received a notched portion 18 of the pole support member 1 whereby the pole support is held in the position shown. This locking arrangement is particularly useful when the skis and poles are to be carried on the shoulder, the poles are located on the inside of the support member 1.

Various other modifications may be made in details of design and construction without departing from the scope and ambit of the invention.

I claim:

1. A ski and pole holder comprising:

a substantially rigid elongated base member having a first substantially flat surface for supporting a pair of skis and a second substantially flat surface opposite said first substantially flat surface;

a first lug extending transversely from said first substantially flat surface adjacent one end of said base member and against which an edge of said skis may bear;

a second lug at said one end of said base member and extending transversely to said base member on both sides thereof to define a first recess in cooperation with said first lug and to define a second recess extending opposite to said first recess;

an elongated pole support member having one end hinged to a second end of said base member by means of a hinge having an axis extending transverse to the direction of elongation of said base member, said pole support member having a first substantially flat surface and a pair of resilient pole holders opposite said first substantially flat surface of said pole support member, whereby said pole support member can be pivoted to a folded position with said first substantially flat surface of said pole support member being adjacent to said second substantially flat surface of said base member; and an elongated, substantially flat flexible strap having one end connected to said second end of said base member and an opposite end having a catch means for engaging one of said first and second recesses, said strap having a length sufficient such that said catch means can engage said second recess when said strap extends over said skis while said skis are supported by said first surface of said base member and said first lug, and such that said catch means can engage said first recess when said strap extends over said pole support member while said holder is in said folded position.

2. The ski and pole holder of claim 1 wherein said first substantially flat surface of said pole support member is positionable in parallel to said second substantially flat surface of said base member when said holder is in an open position.

3. A ski and pole holder according to claim 1 wherein the hinge has means for locking the pole support member at a predetermined angle relative to the base member.

* * * * *